US009786984B2

(12) United States Patent
Zaghloul et al.

(10) Patent No.: US 9,786,984 B2
(45) Date of Patent: Oct. 10, 2017

(54) PORTABLE ANTENNA

(71) Applicant: U.S. Army Research Laboratory ATTN: RDRL-LOC-I, Washington, DC (US)

(72) Inventors: Amir I. Zaghloul, Bethesda, MD (US); William T. Fraser, Jr., Edgewater, MD (US); Theodore K. Anthony, Randallstown, MD (US); Andrew J. Bayba, Beltsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 520 days.

(21) Appl. No.: 14/309,035

(22) Filed: Jun. 19, 2014

(65) Prior Publication Data

US 2016/0315372 A1 Oct. 27, 2016

Related U.S. Application Data

(60) Provisional application No. 61/901,283, filed on Nov. 7, 2013.

(51) Int. Cl.
*H01Q 1/42* (2006.01)
*H01Q 1/36* (2006.01)
(Continued)

(52) U.S. Cl.
CPC ..... *H01Q 1/36* (2013.01); *H01Q 1/088* (2013.01); *H01Q 1/10* (2013.01)

(58) Field of Classification Search
CPC ..... H01Q 1/42; H01Q 1/244
(Continued)

(56) References Cited

U.S. PATENT DOCUMENTS 2,183,833 A * 12/1939 Farhar ..... A45B 25/14 135/120.2
3,397,399 A * 8/1968 Carman ..... F24J 2/125 135/33.2

(Continued)

OTHER PUBLICATIONS

"Light Weight TACSAT Antenna System" brochure. Available online at: http://www.tserecon.com/images/Antenna_Lightweight_13.6.25.pdf. Electronic file indicated as being created Jun. 25, 2013.

(Continued)

*Primary Examiner* — Hoang Nguyen
*Assistant Examiner* — Jae Kim
(74) *Attorney, Agent, or Firm* — Eric Brett Compton

(57) ABSTRACT

An antenna having an elongated housing open at one end and defining an interior chamber. A telescoping mast has a carrier attached at a first end and a flexible antenna attached at its other end. The carrier with the attached mast and antenna is movable between a storage position in which the carrier, mast, and antenna are contained within the interior chamber of the housing, and a deployed position in which the mast and attached antenna protrude outwardly from the housing. A spring is positioned between the carrier and the housing which urges the carrier towards its deployed position. A catch mechanism selectively holds the carrier in its stored position and, when released, releases the spring to move the antenna to its deployed position.

18 Claims, 3 Drawing Sheets

(51) Int. Cl.
*H01Q 1/08* (2006.01)
*H01Q 1/10* (2006.01)

(58) Field of Classification Search
USPC ..... 343/702, 718, 872, 874, 895
See application file for complete search history.

(56) References Cited

U.S. PATENT DOCUMENTS 3,707,720 A * 12/1972 Staehlin ..... H01Q 15/161 343/755
5,550,552 A * 8/1996 Oxley ..... H01Q 1/526 343/702
6,273,111 B1 * 8/2001 Weiss ..... A45B 19/00 135/15.1
6,340,956 B1 * 1/2002 Bowen ..... H01Q 15/161 343/840
6,816,128 B1 * 11/2004 Jennings ..... H01Q 1/081 343/700 MS
7,126,553 B1 * 10/2006 Fink ..... H01Q 1/08 343/767
7,665,477 B1 * 2/2010 Hathaway ..... A45B 25/006 135/16
9,608,333 B1 * 3/2017 Toledo ..... H01Q 15/161
2005/0033235 A1 * 2/2005 Flint ..... A61B 17/3472 604/157
2005/0146484 A1 * 7/2005 Massey ..... H01Q 1/362 343/915
2008/0191950 A1 * 8/2008 Chang ..... H01Q 1/276 343/718
2009/0036227 A1 * 2/2009 Moore ..... F16B 35/041 473/316
2012/0103376 A1 * 5/2012 Becher ..... A45B 3/00 135/16
2012/0167932 A1 * 7/2012 Banerjee ..... A45B 11/00 135/16
2013/0092206 A1 * 4/2013 Tayebi ..... A45B 19/04 135/98
2013/0092715 A1 * 4/2013 Tayebi ..... A45B 11/02 224/576
2015/0216273 A1 * 8/2015 Akin ..... A45B 25/00 135/16
2015/0333391 A1 * 11/2015 Pryor ..... H01Q 1/08 343/718

OTHER PUBLICATIONS

"A Study on Conical Spiral Antennas for UHF SATCOM Terminals" presented at the IEEE International AP-S Symposium in Chicago, Illinois on Jul. 2012. (paper and slide presentation).
Select film frames from movie: "Who's Afraid of Virginia Woolf?" (1966).

* cited by examiner

Fig-1
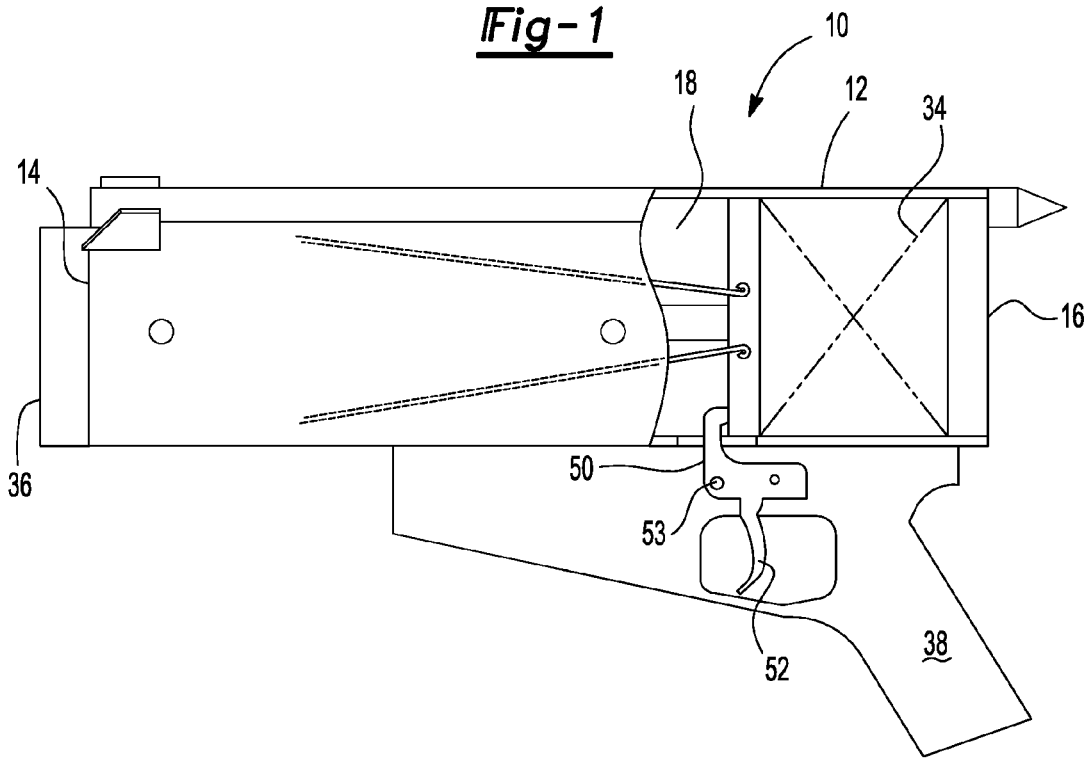
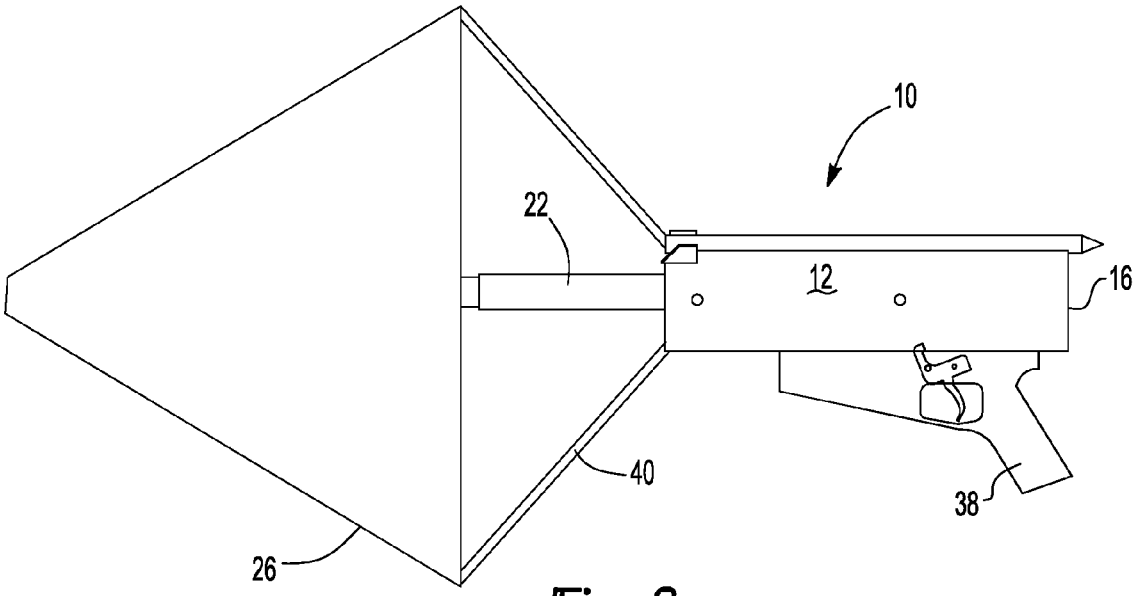
Fig-2

PORTABLE ANTENNA

CROSS-REFERENCE TO RELATED APPLICATIONS

This application claims priority of U.S. Provisional Application No. 61/901,283 filed Nov. 7, 2013, the contents of which are incorporated herein by reference.

GOVERNMENT INTEREST

The invention described herein may be manufactured, used, and licensed by or for the United States Government.

BACKGROUND OF THE INVENTION

I. Field of the Invention

The invention relates generally to antennas and, more particularly, to a portable antenna which may be used for satellite communications.

II. Description of Relevant Art

There are many situations, particularly in military operations, in which it is desirable to deploy an antenna for high frequency use, such as for satellite communications. Previously, antennas used by the military for satellite communications as well as other high frequency communications are assembled in fixed locations. Such fixed locations, however, are oftentimes not conveniently located, particularly during periods of unexpected troop movements. When this occurs, the previously known satellite terminals must be disassembled, moved to new locations, and then reassembled. Such disassembly and reassembly of the antenna systems, however, is time consuming and oftentimes not practical.

SUMMARY OF THE PRESENT INVENTION

The present invention provides a portable antenna which overcomes the above mentioned disadvantages of the previously known antennas.

In brief, the antenna assembly of the present invention includes an elongated housing open at one end and defining an interior chamber. Preferably, the housing is tubular and cylindrical in shape and closed at its other end.

A telescoping mast has a carrier attached to one end which is slidably received within the housing chamber. The carrier, together with its attached mast, is movable between a storage position, in which the carrier and mast are positioned within the housing chamber, and a deployed position in which the carrier moves to adjacent the open end of the housing and the mast protrudes outwardly from the housing.

A flexible antenna is secured to the mast which is also contained within the housing chamber when in its storage position. However, when the mast moves to its deployed position, the flexible antenna also moves outwardly from the housing chamber and flares into a generally conical shape. The flexible antenna itself is constructed from an electrical insulating material while an electrically conductive material is deposited in a pattern on the flexible antenna to form the radiator for the antenna.

A spring is entrapped between the carrier for the mast and the closed end of the housing. This spring is maintained in a compressed position when the mast with its attached antenna is contained in the storage position within the housing chamber. A catch mechanism, such as a trigger, however, releases the force of the spring which then propels the carrier with its attached mast and antenna outwardly from the open end of the housing and to its deployed position. Preferably, movable struts attached to the housing adjustably support the antenna on a ground surface.

In order to ensure that the antenna forms a conical shape when in its deployed position, preferably a plurality of struts are pivotally connected to the housing carrier and extend through a guide plate at the open end of the housing. Thus, upon deployment of the antenna, the struts extend through openings in the guide plate so that the struts extend outwardly from the housing. However, the position of the holes in the guide plate ensures that, when the antenna is fully deployed, the struts flare outwardly from each other. Furthermore, a free end of the strut is secured to the antenna thus forcing the antenna into a generally conical shape.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a partial fragmentary view illustrating a preferred embodiment of the portable antenna assembly of the present invention in a stored position;

FIG. 2 is a side view of the antenna assembly of the present invention in a deployed position;

DETAILED DESCRIPTION OF A PREFERRED EMBODIMENT OF THE PRESENT INVENTION

Figure 5:
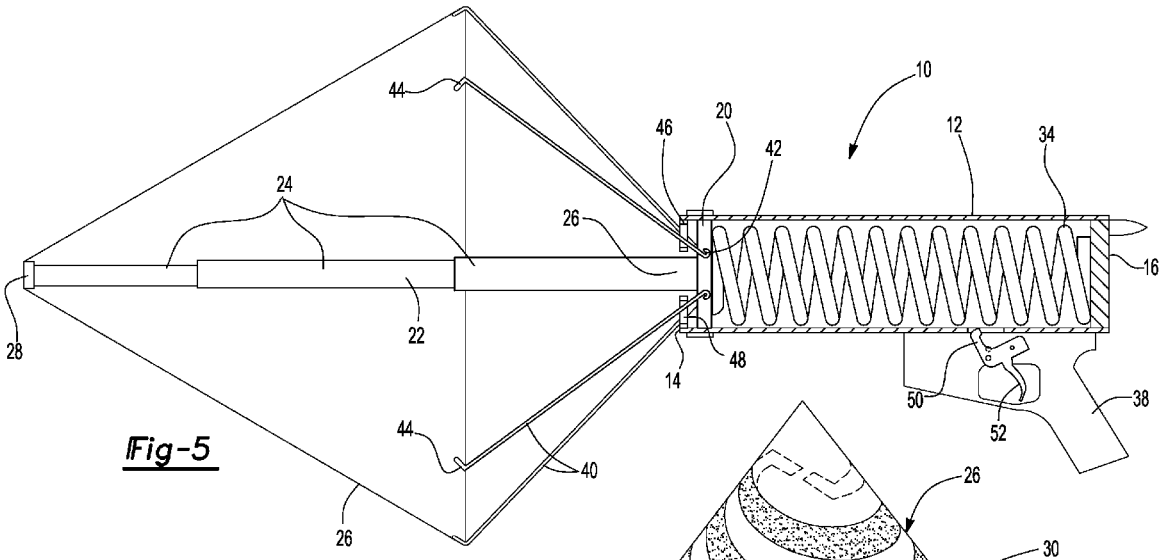
FIG. 5 is a longitudinal sectional view illustrating the antenna assembly in a deployed position.

With reference first to FIGS. 1 and 5, a preferred embodiment of the portable antenna 10 of the present invention is shown. The antenna assembly 10 includes an elongated housing 12 which is preferably tubular and cylindrical in shape. The housing 12 is constructed of any conventional material, such as metal, and is open at one end 14 and closed at its other end 16 thus defining a generally cylindrical interior housing chamber 18. Preferably, the assembly 10 is adapted to be handheld by means of a hand grip 38 attached to the housing 12.

A carrier 20 is axially slidably mounted within the housing chamber 18 and movable between a storage position, illustrated in FIG. 1, and a deployed position, illustrated in FIG. 5. A telescoping mast 22 having at least two and preferably three telescoping sections 24 has one end attached to the carrier 20 so that the carrier 20 and mast 22 move in unison with each other. Preferably, the mast sections 24 are tapered in diameter so that the mast sections 24 lock together when the mast 22 is in its fully deployed position as shown in FIGS. 2 and 5.

Figure 6:
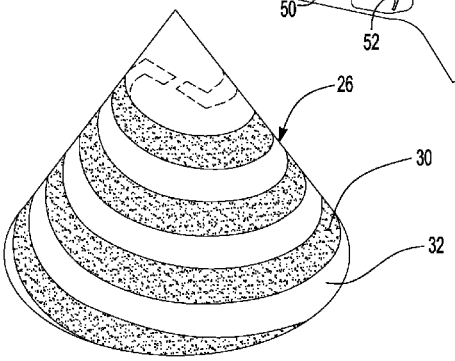
FIG. 6 is a perspective view of one conical spiral antenna configuration for the antenna according to an embodiment.

With reference to FIGS. 2, 5, and 6, a flexible antenna 26 is secured to a free end 28 of the mast 22 so that the antenna 26 and mast 22 move in unison with each other. The antenna 26 may be formed of a flexible material that is readily capable of being folded and unfolded, and to provide the ability to receive and/or transmit RF signals. The antenna 26 preferably comprises a flexible substrate 30, made of any flexible material, such as cloth or a polymeric material having a low loss dielectric, having one or more electrically conductive antenna radiators 32 deposited on the substrate 30. For example, the antenna 26 may be formed of various materials, including fabric such as cloth or a polymeric material, e.g., sold under the Mylar® brand. In other embodiments, the one or more radiators 32 may form the substrate 30 themselves without the need of any additional substrate.

The radiators 32 may be printed, stitched, or otherwise attached to the substrate 30. A single electrically conductive radiator 32 is illustrated in FIG. 6 as spiral in shape, although it will be appreciated that other shapes and configurations may be used for the radiator(s) 32 without deviation from the spirit or scope of the invention. For example, radiators 32 may be arranged as concentric circles, an array of patches, or other radiating configuration on the substrate 30.

The diameter of the antenna 26 will have a substantial effect on the overall weight, stowed size and mechanical design of the assembly 10. Overall, the antenna 26 may have dimensions of around 20 inches in diameter when deployed in some embodiments. The parameters of the antenna design can be selected to satisfy certain performance requirements as desired.

Referring now to FIGS. 1 and 5, a spring 34 is contained within the housing 12 and sandwiched between the carrier 20 and the closed end 16 of the housing 12. As shown, the spring 34 may be a helical compression spring. With the antenna 30 in its storage position as shown in FIG. 1, the compression spring 34 is compressed between the closed end 16 of the housing and the carrier 20. Simultaneously, the mast 22 is in a collapsed position so that the mast 22 together with the antenna 30 are all contained within the housing chamber 16. A removable cap 36 can be attached to the free end 28 of the mast 22 which covers and closes the open end 14 of the housing 12 to prevent dirt or debris from entering. In its storage position (FIG. 1), the entire antenna assembly may be easily held and transported by the hand grip 38 attached to the housing 12.

With reference now particularly to FIG. 5, in order to ensure that the antenna 26 assumes a conical shape of preferably about 60 degrees when in its deployed position, a plurality of elongated spars 40 each have one end 42 attached to and pivotally connected to the carrier 20. The other ends 44 of the spars 40 are attached at circumferentially spaced positions around the antenna substrate 30.

An annular guide plate 46 is connected to the housing adjacent its open end 14. This guide plate 46 includes a plurality of circumferentially spaced openings 48 and one spar 40 extends through each opening 48 in the guide plate 46. These openings 48, however, are spaced radially outwardly from the attachment points of their associated spars 40. Consequently, as the spars 40 move from their stored and to their deployed position, the coaction between the spars 40 and the guide plate openings 48 causes the spars 40 to flare outwardly as shown in FIGS. 2 and 6. This, in turn, forces the antenna 26 into the desired generally conical shape.

With reference now to FIGS. 1 and 5, a catch mechanism 50, preferably operated by a trigger 52, is mounted within the housing 12 which engages the carrier 42 when in its stored position to hold the carrier 42 with its attached mast 22 and antenna 26 in the storage position within the housing chamber 18 (FIG. 1). When in its storage position, the spring 34 is in a state of compression. Actuation of the catch mechanism 50 by the trigger 52 as shown in FIG. 5, however, releases the carrier 42 which enables the spring 34 to propel the carrier 20, mast 22, and antenna 26 to its deployed position. A safety pin 53 mounted to the housing 18 locks the catch mechanism 50 to the housing 12 and thus disables the trigger mechanism 50 until the safety pin 53 is removed. The safety pin 53 thus prevents accidental or unintended deployment of the antenna 26. The catch mechanism 50 may be spring-biased to keep it in an upward, locking position by default.

Figure 3:
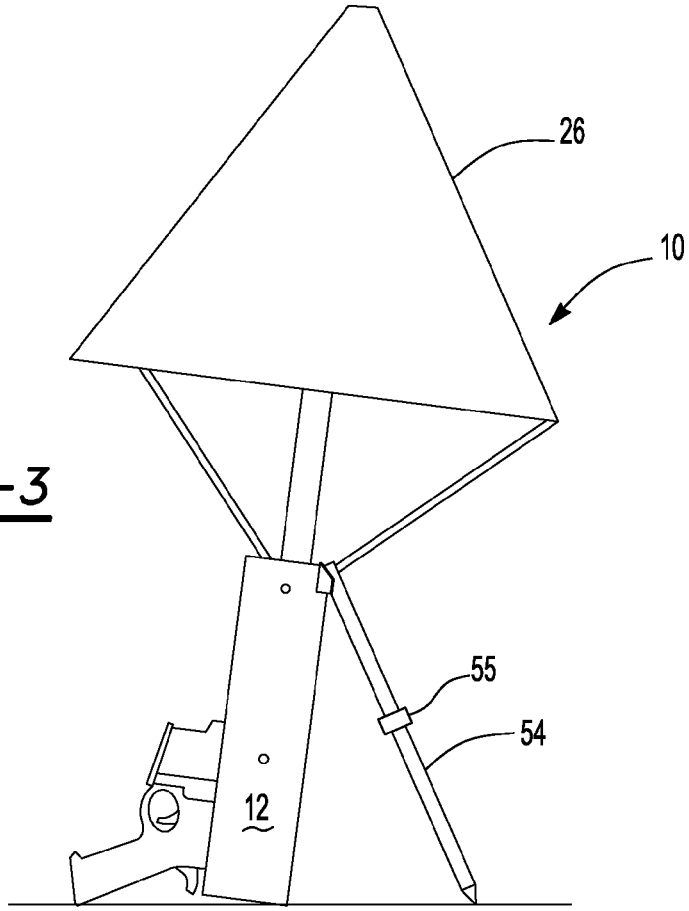
FIG. 3 is a perspective view illustrating the antenna assembly in a deployed position and resting of the ground.
Figure 4:
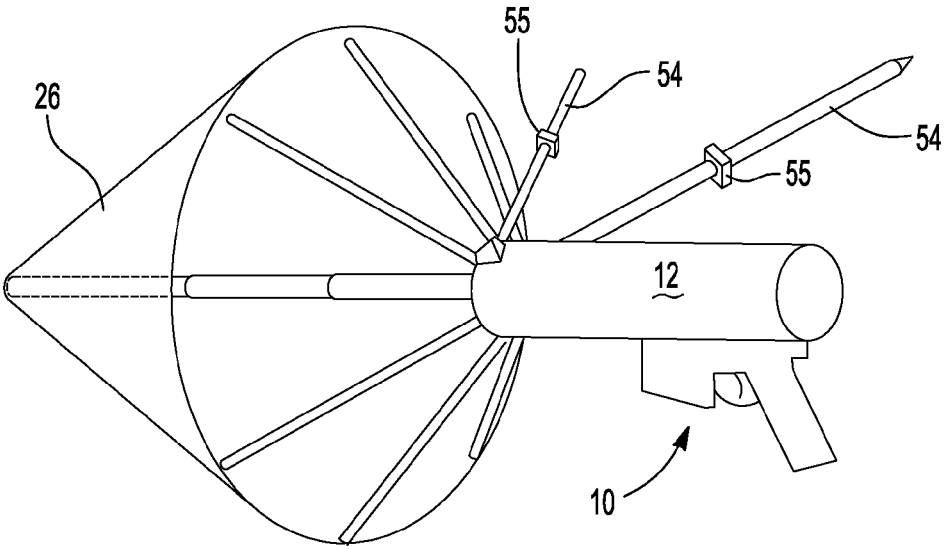
FIG. 4 is a perspective view illustrating the antenna assembly in a deployed position and no longer resting on the ground.

As best shown in FIGS. 3 and 4, a plurality of housing struts 54 are preferably pivotally connected to the housing 12. These struts 54 facilitate easy placement and adjustment of the antenna after deployment. These struts 54, furthermore, are preferably adjustable in length, e.g. by a fitting 55, such as a threaded fitting or telescoping leg fitting, to facilitate positioning of the antenna on the ground after deployment. Two of the housing struts 54 and the housing 12 can make adjustable 3-legged mounting arrangement for any desired deployment direction of the antenna.

In operation, the antenna is initially in its stored position as illustrated in FIG. 1. In its stored position, the telescoping mast 22 is collapsed and positioned within the housing chamber 18 together with the spars 40 and antenna 26. The cap 36 closes the open end of the housing 18 and the catch mechanism 50 retains the now compressed spring 34 in a state of compression. The safety pin 52 prevents accidental or unintended deployment of the antenna 26.

When deployment of the antenna 26 is desired, the safety pin 52 is removed and the catch mechanism 50 actuated. Upon actuation, the catch mechanism 50 releases the spring 18 which propels the mast 22, antenna 26, and spars 40 out through the open end 14 of the housing 18. In doing so, the guide plate 46 not only retains the carrier 42 within the housing chamber 18, but also flares the spars 40 outwardly to ensure that the antenna 26 is conical in shape.

The antenna assembly 10 is then positioned as desired, with or without the use of the struts 54, and radio communications may be conducted using the antenna radiator 32 in any conventional fashion. More partially, the antenna may be pointed toward a communication source, such as a satellite. The required elevation and azimuth angles for pointing are functions of the antenna location and the satellite orbital location. An external device or an antenna-mounted chip, with or without a look-up table can be easily devised to be used with the antenna for positioning. Although the lengths of the struts 54 are adjustable and can be used to provide some pointing relative to zenith direction, the pointing can be accomplished, for instance, using a flexible annulated ring connected to the base of the deployed antenna 26. The antenna 10 can be pointed in both azimuth and elevation within limited angular spread. Wider angular movement can be done by adjusting the length of the supporting struts 54 for elevation control, and by rotating the supporting struts 54 for azimuth control. Similar to the annulated joint, a ball-and-socket section can be used at the base of the deployed antenna to provide elevation and azimuth pointing within wide angles. Pre-set marks can be provided on the housing 12 for accurate pointing relative to reference directions.

After use of the antenna assembly 10 has been completed, the mast 22 and antenna 26 may be returned to their storage position by forcing the mast 22 with the antenna 26 back into the interior chamber 18 of the housing 12 until the catch mechanism 50 engages the carrier 20 and retains it within the housing chamber 18. The safety pin 52 is then replaced and the entire antenna assembly 10 is ready for a subsequent deployment when desired.

In other embodiments, the antenna assembly 10 may optionally include light emitting diodes (LEDs) to indicate signal strength, the operational mode, and/or the elevation angle of the antenna.

FIG. 6 is a perspective view of one conical spiral antenna configuration for antenna 26 which may be used according to an embodiment. A more detailed description the design of an exemplary conical spiral antenna may be found in a paper by A. I. Zaghloul et al., titled "A Study on Conical Spiral Antennas for UHF SATCOM Terminals" presented at the IEEE International AP-S Symposium in Chicago, Ill. on July 2012. That paper is herein incorporated by reference in its entirety. The antenna 26 may function in transmit and/or receive mode. In some embodiments, the input (or output) of the spiral radiator 32 may connect through a balun to a coaxial cable that is connected to one side of a two-way switch. The other side of that switch may be connected to another antenna that can function, for instance, as an FM antenna.

From the foregoing, it can be seen that the present invention provides a portable antenna for high frequency communications, such as satellite communications, which may be rapidly deployed when desired. Having described my invention, however, many modifications thereto will become apparent to those skilled in the art to which it pertains without deviation from the spirit of the invention as defined by the scope of the appended claims.

NUMBER KEY

10 antenna assembly
12 housing
14 open end
16 closed end
18 chamber
20 carrier
22 mast assembly
24 mast sections
26 antenna
28 free end
30 substrate
32 radiator
34 spring
36 cap
38 hand grip
40 spar
42 spar end
44 strut end
50 catch mechanism
52 trigger
53 safety pin
54 leg
55 fitting
56 support leg

We claim:

1. An antenna comprising:

an elongated housing having an open end and an opposing end defining an interior chamber therebetween, a flexible antenna, a telescoping mast having a carrier attached at a first end, a second end of said mast being attached to said antenna, said carrier being slidably received in said housing chamber and movable between a storage position in which said carrier and said antenna are contained in said interior chamber and said carrier is positioned adjacent the opposing end of said housing chamber and said mast is in a collapsed position; and a deployed position in which said carrier is positioned adjacent said open end of said housing and said mast protrudes outwardly from said housing in an extended position and said antenna is positioned exteriorly of said housing, a spring positioned between said carrier and said housing which urges said carrier towards said deployed position, a catch mechanism which selectively holds said carrier in said stored position and said spring in a state of compression, a plurality of spars having two end, one end pivotally attached to said carrier and the other end attached to said antenna at spaced positions, and a guide plate attached to said housing adjacent said first end, said guide plate having a plurality of holes, said spars each moving through one associated hole in said guide plate.

2. The antenna as defined in claim 1 wherein said guide plate holes are positioned so that, as said carrier moves to said deployed position, said spars flare outwardly from said open end of said housing.

3. The antenna as defined in claim 1 wherein said guide plate overlies said carrier to thereby entrap said carrier in said housing chamber.

4. The antenna as defined in claim 1 wherein said catch mechanism comprises a trigger which, when depressed, releases said spring to move said carrier to said deployed position.

5. The antenna as defined in claim 1 wherein said mast comprises at least two tapered telescoping sections.

6. The antenna as defined in claim 1 wherein said mast comprises at least three tapered telescoping sections.

7. The antenna as defined in claim 1 wherein said antenna comprises a conductive strip attached to a sheet of electrical insulating material.

8. The antenna as defined in claim 7 wherein said sheet of material is conical in shape and said conductive strip has a spiral pattern.

9. The antenna as defined in claim 1 and comprising a plurality of support legs attached to said housing.

10. The antenna as defined in claim 9 wherein said legs are pivotally attached to said housing.

11. The antenna as defined in claim 9 wherein the length of said legs is adjustable.

12. The antenna as defined in claim 1 and comprising a lock pin removably attached to said housing to lock said carrier in said stored position.

13. The antenna as defined in claim 1 and comprising a removable cap attachable to said antenna to cover said open end of said housing when said carrier is in said stored position.

14. The antenna as defined in claim 1 wherein said antenna is configured for satellite communications.

15. The antenna as defined in claim 1, comprising a hand grip attached to and extending from the housing for a holder to grasp, and said catch mechanism comprises a trigger positioned proximate to the hand grip, which, when depressed by the holder's finger, releases the catch mechanism to operatively deploy the flexible antenna.

16. The antenna as defined in claim 15, comprising a pair of support legs attached to said housing, wherein the rear of the hand grip and the legs support the antenna.

17. The antenna as defined in claim 1, wherein, with application of manual force upon the telescoping mast, telescoping mast collapses to the collapsed state and the carrier and antenna are returned to the storage position within the interior chamber.

18. A handheld deployable antenna comprising:

an elongated housing having an open end and a closed end defining an interior chamber therebetween, a foldable flexible antenna having a conical shape when unfolded, a telescoping mast having a carrier attached at a first end, a second end of said mast being attached to said antenna, said carrier being slidably received in said housing chamber and movable between a storage position in which said carrier and said antenna in a folded state are contained in said interior chamber and said carrier is positioned adjacent the closed end of said housing chamber and said mast is in a collapsed position, and a deployed position in which said carrier is positioned adjacent said open end of said housing and said mast protrudes outwardly from said housing in an extended position and said antenna is positioned exteriorly of said housing in an unfolded state, a plurality of spars having two ends, one end pivotally attached to said carrier and other end attached to said antenna at spaced positions, a guide plate attached to said housing adjacent said first end, said guide plate having a plurality of holes, said spars each moving through one associated hole in said guide plate, wherein said guide plate holes are positioned so that, as said carrier moves to said deployed position, said spars flare outwardly from said open end of said housing, a spring positioned near the closed end of said housing which urges said carrier towards said deployed position, a handle having a pistol grip attached to and extending from the housing near its closed end for a holder to grasp, and a catch mechanism which selectively holds said carrier in said stored position and said spring in a state of compression, said catch mechanism comprises a trigger positioned proximate to the handle, which, when depressed by the holder's finger, releases the catch mechanism to operatively deploy the flexible antenna in the unfolded state.

* * * * *